US010349724B2

(12) United States Patent
Lambdin

(10) Patent No.: US 10,349,724 B2
(45) Date of Patent: Jul. 16, 2019

(54) MAKEUP ACCESSORY DEVICE

(71) Applicant: Breanna Lambdin, Indialantic, FL (US)

(72) Inventor: Breanna Lambdin, Indialantic, FL (US)

( * ) Notice: Subject to any disclaimer, the term of this patent is extended or adjusted under 35 U.S.C. 154(b) by 350 days.

(21) Appl. No.: 15/348,524

(22) Filed: Nov. 10, 2016

(65) Prior Publication Data

US 2017/0127800 A1 May 11, 2017

Related U.S. Application Data

(60) Provisional application No. 62/253,452, filed on Nov. 10, 2015.

(51) Int. Cl.

| | |
|---|---|
| ***A45D 8/22*** | (2006.01) |
| ***A45D 40/24*** | (2006.01) |
| ***A45D 40/26*** | (2006.01) |
| ***A45D 40/18*** | (2006.01) |
| *A45D 40/00* | (2006.01) |

(52) U.S. Cl.

CPC ..... *A45D 40/24* (2013.01); *A45D 40/18* (2013.01); *A45D 40/265* (2013.01); *A45D 40/00* (2013.01); *A45D 2200/1072* (2013.01)

(58) Field of Classification Search

CPC ..... A45D 40/00; A45D 40/18; A45D 40/24; A45D 40/265; B65D 21/0224; B65D 21/0228; B65D 21/0209

USPC ..... 220/4.26

See application file for complete search history.

(56) References Cited

U.S. PATENT DOCUMENTS

| | | | | |
|---|---|---|---|---|
| 2003/0152410 | A1* | 8/2003 | Huang | A45D 40/24 401/19 |
| 2009/0293905 | A1* | 12/2009 | Albert | A45D 33/26 132/296 |
| 2014/0224757 | A1* | 8/2014 | McWhorter | B65D 21/0228 215/10 |
| 2015/0189973 | A1* | 7/2015 | Swain | A45D 40/18 401/18 |
| 2017/0105507 | A1* | 4/2017 | Golding | A45D 40/24 |

* cited by examiner

*Primary Examiner* — Rachel R Steitz
(74) *Attorney, Agent, or Firm* — Mark Malek; Widerman Malek, PL

(57) ABSTRACT

A device including a plurality of components that are connectable to one another. Each of the plurality of components may include a component top having a threaded portion and a component carrier having a threaded portion adapted to threadably connect to the component top. A plurality of connector members may be adapted to be positioned between each of the plurality of components. Each of the plurality of connector members may have a threaded portion adapted to threadably connect to a threaded portion of each of the plurality of components. The plurality of components and the plurality of connector members may be adapted to be threadably connected to one another to form a single unit having a plurality of different components capable of carrying various cosmetic related items.

10 Claims, 2 Drawing Sheets

MAKEUP ACCESSORY DEVICE

RELATED APPLICATIONS

This application claims the benefit under 35 U.S.C. § 119(e) of U.S. Provisional Patent Application Ser. No. 62/253,452 filed Nov. 10, 2015, the entire contents of which are incorporated herein by reference.

FIELD OF THE INVENTION

The present invention relates to the field of makeup accessory devices and, more specifically, to make up applicator cases that may be modular in nature.

BACKGROUND

Especially for a person with a large carry bag, such as a handbag or backpack, it is difficult to find and keep together two or more longitudinally extending articles. For example, one may want to apply lipstick and mascara. One may also desire to use a bobby pin or other accessory while applying makeup. However, there has not been a device to hold multiple items together in proximity so that the user can have easy access to beauty items and accessories simultaneously, without having to search through many items within the carry bag.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a device including a plurality of components that are connectable to one another and a plurality of connector members. Each of the plurality of components may include a component top having a threaded portion and a component carrier having a threaded portion adapted to threadably connect to the component top. The plurality of connector members may be adapted to be positioned between each of the plurality of components. Each of the plurality of connector members may have a threaded portion adapted to threadably connect to a threaded portion of each of the plurality of components. The plurality of components and the plurality of connector members may be adapted to be threadably connected to one another to form a single unit having a plurality of different components capable of carrying various cosmetic related items.

The device may include a first component, a second component, a third component, and two spacers. The first component may include a first component top, an applicator, a first component container, and a first component connector member. The first component top may have a threaded portion. The applicator may be fixedly secured to the top. The first component container may have a threaded portion adapted to mate with the threaded portion of the first component top. The first component connector member may be located on a bottom portion of the first component container. The first component container may be adapted to receive the applicator when mated, to the top.

The second component may include a con component container, a first second component connector member, and a second second component connector member. The second component container may have an empty interior portion. The first second component connector member may be located on a first end of the second component container. The second second component connector member may be located on a second end of the second component container.

The third component may include a third component top, an elongate cosmetic product, a third component container, a twist mechanism, and a third component connector member.

The third component container may be adapted to carry the elongate cosmetic product and be received by the third component top and secured with a friction fit. The twist mechanism may be located on an end of the third component container and adapted to move the elongate cosmetic product between a retracted position and an extended position. The third component connector member may be located on the end of the third component container.

A first spacer may be adapted to receive the first component connector member and the first second component connector member. A second spacer may be, adapted to receive the second second component connector member and the third component connector member.

DETAILED DESCRIPTION OF THE INVENTION

Figure 1:
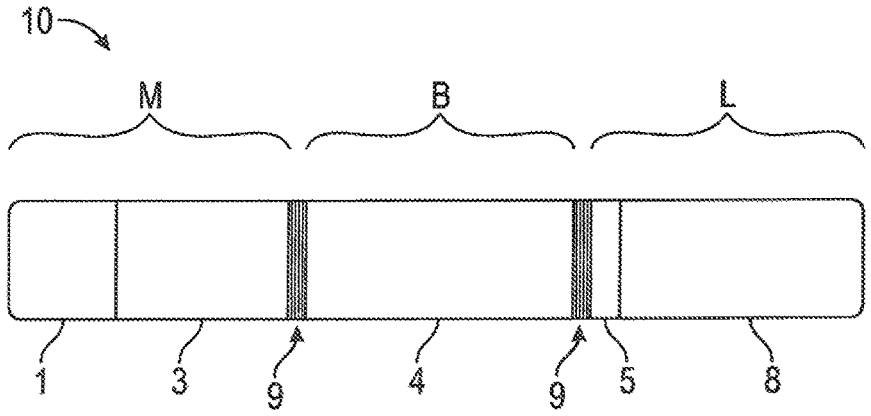
FIG. 1 is a side view of a makeup accessory device according to an embodiment of the present invention.
Figure 2:
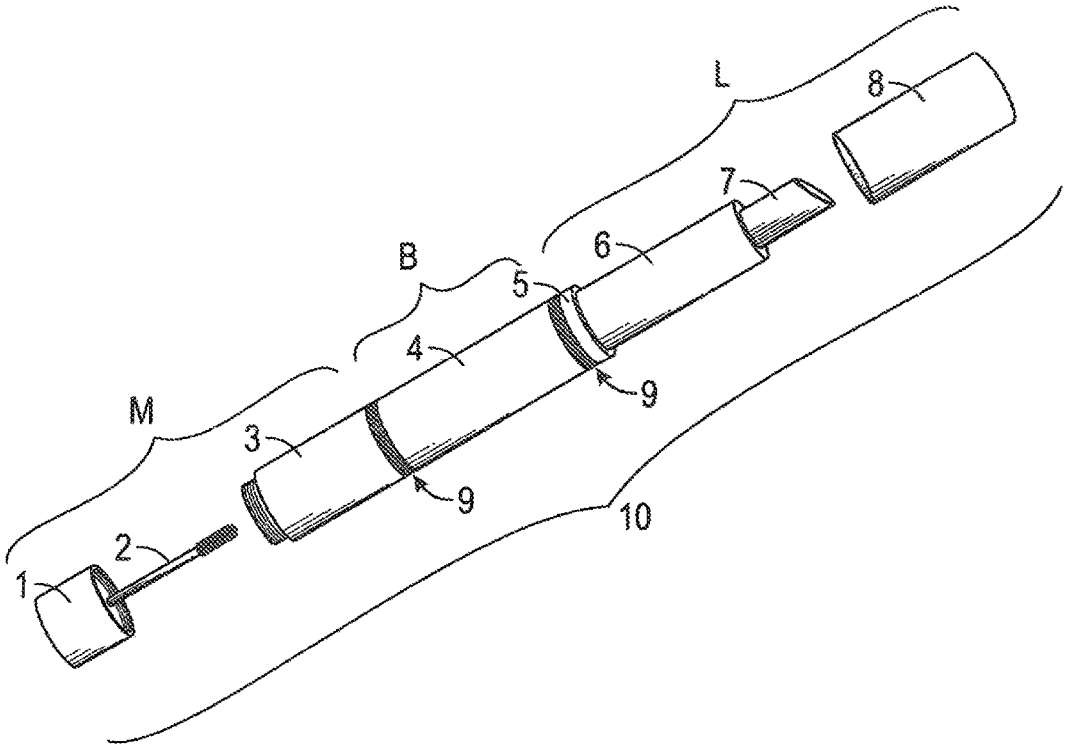
FIG. 2 is an exploded perspective view of the makeup accessory device illustrated and FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a makeup accessory device 10 advantageously allows for plurality of different makeup accessories to be carried as a single unit. For example, and as perhaps best illustrated in FIG. 1, the makeup accessory device 10 according to the present invention may include a first component M, a second component B, and a third component L. The first component M may, for example, be suitable for carrying mascara. The second component B may, for example, be suitable for carrying hair accessories, such as bobby pins. The third component L may, for example, be suitable for carrying lipstick or lip gloss. Those skilled in the art will appreciate that any of the first, second, or third components M, B, L, may be suitable for carrying any number of makeup or hair accessories.

Figure 4:
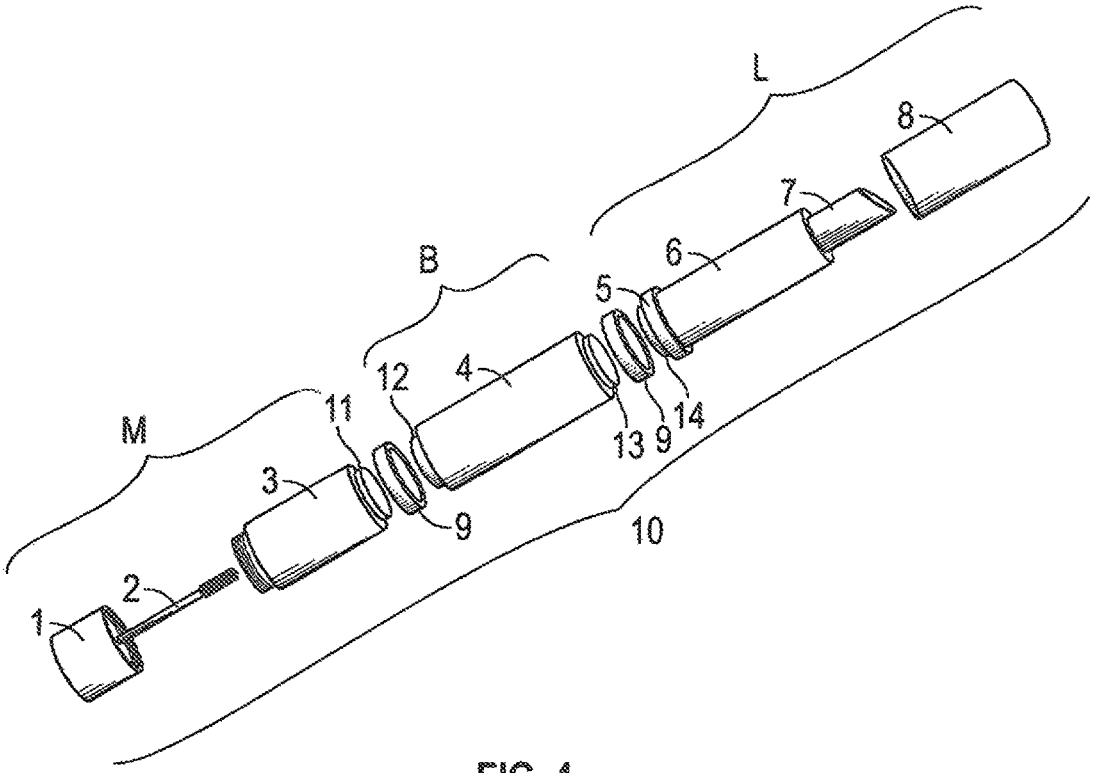
FIG. 4 is another exploded perspective view of a makeup accessory device according to the present invention.

As further illustrated in FIG. 1, the first, second and third components, M, B, L, may be connectable to one another so that the first, second and third components, M, B, L may be carried as a single unit. As perhaps best illustrated in FIG. 4, for example, the first, second and third components, M, B, L, may also be disconnected from one another so as to be carried as separate units. Further, although the makeup accessory device 10 is illustrated as having first, second and third components, M, B, L, those skilled in the art will appreciate that the makeup accessory device according to embodiments of the present invention may include any number of components. Further, the order in which the first, second and third components, M, B, L, are connected are irrelevant. In other words, the order in which the first, second and third components, M, B, L, are connected may be any order while still accomplishing the goals, features, and objectives according to the present invention. For example, the order may be second component B, first component M, third component L, or any other combination as understood by those skilled in the art.

Figure 3:
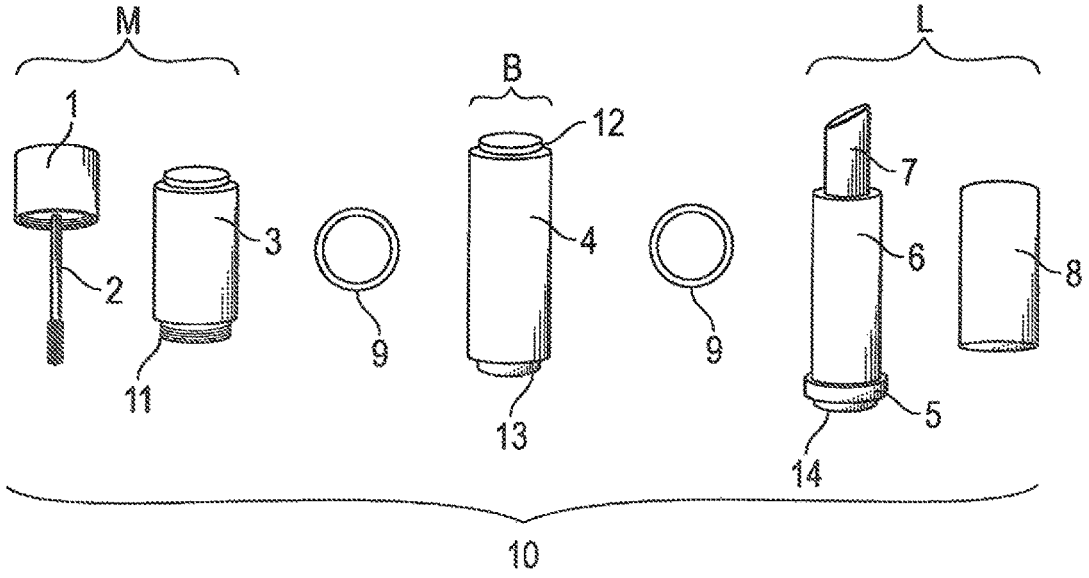
FIG. 3 is an exploded perspective view of components of a makeup accessory device according to embodiments of the present invention.

As perhaps best illustrated in FIG. 3, the first component M may, for example, include a container 3, a top 1 and an applicator 2. The applicator 2 may be connected to the top 1 and extend downwardly therefrom and be adapted to be positioned within the container 3. Further, the top 1 may be adapted to threadably connect to the container 3 so as to form a seal thereon. A bottom portion of the container 3 may include a first component connector member 11.

As also illustrated in FIG. 3, the second component B may include a container 4 having an empty interior portion suitable for carrying various items. For example, the container 4 of the second component B may be sized to carry bobby pins. Those skilled in the art will appreciate, however, that the interior portion of the container 4 may be sized to carry other accessories as well. A pair of second component connector members 12, 13 may be include on the second component B. Those skilled in the art will appreciate, however, that the second component B may include only one second component connector member 12, 13.

As further illustrated in FIG. 3, the third component L may include a container 6 and a top 8 adapted to be positioned over the container. The container may be, adapted to carry an elongate cosmetic product 7, such as, by way of example and not as a limitation, lipstick, eyeliner, or the like. In cases where the third component L is lipstick, the third component may include an elongate cosmetic product 7 to be applied to the lips of a user carried within the container 6. A twist mechanism 5 may be positioned adjacent a bottom portion of the container 6 to allow for the elongate cosmetic product 7 to be moved between a retracted position and an extended position. A bottom portion of the third component L may include a third component connector member 14.

Accordingly, the first, second and third components, M, B, L are adapted to connect to one another using the first component connector member 11, the second component connector member(s) 12, 13, and the third component connector member 14. The first component M is detachably connected to a first end of the second component B and the third component L is detachably connected to a second end of the second component B. More specifically, the first, second and third components, M, B, L may be threadably connected to one another. In embodiments of the makeup accessory device 10 where the first, second and third components, M, B, L are threadably connected to one another, each of the first component connector member 11, the second component connector member(s) 12, 13 and the third component connector member 14 may be threaded.

Those skilled in the art will appreciate that when the first component M threadably connected to the second component B, it may act as a top, bottom, or lid to secure the open interior portion of the second component. Similarly, when the third component L is threadably connected to the second component B, it may also act as a top, bottom or lid to secure the open interior portion of the second component. Those skilled in the art will further appreciate that although a threaded connection is described between the first, second and third components, M, B, L, the present invention contemplates other connections between the first, second and third components. For example, the first, second and third components, M, B, L may be connected to one another by a simple meeting engagement, or any other connection as may be understood by those skilled in the art after having had the benefit of reading this disclosure.

Those skilled in the art will also appreciate that the present invention contemplates use of caps to cover the openings in the second component B so that the second component can be used apart from the makeup accessory device 10 as a whole. In other words, when using the caps to cover the openings in the second component B, the caps may be connected (in some cases threadably connected) to the second component connection members 12, 13 so that the second component may be sealable and better suited to carry various accessories, e.g., hair accessories.

In some embodiments of the makeup accessory device 10 according to the present invention, a plurality of spacers 9 may be included. The spacers 9 may, for example, be positioned between each of the first, second and third components, M, B, L. The spacers 9 may be used to provide space between each of the first, second and third components, M, B, L. The spacers 9 may also be used to provide a universal fit between each of the first, second and third components, M, B, L. For example, the spacers 9 may provide a female threaded connection, while the first component connection member 11, each of the second component connections members 12, 13 and the third component connection member 14 may each be male threaded connection members. Accordingly, the male threaded connection members of each of the first component connection member 11, the second component connection members 12, 13, and the third component connection member 14 may threadably engaged the threaded portions of each of the spacers 9. Those skilled in the art will appreciate that each of the spacers 9 may include a thread pattern that allows for each of the first component connection member 11, a second component connection member 12, 13, and the third component connection member 14 to be simultaneously and readily threadably connectable thereto.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc do not denote any order or importance, but rather the terms first, second, etc. are used to distinguish, one element from another. Furthermore, the use of the terms a, an, etc. do not denote a limitation of quantity, but rather denote the presence of at least one of the referenced item.

That which is claimed is:

1. A device comprising:

a first component comprising:

a first component top having a threaded portion, an applicator fixedly secured to the first component top, a first component container having a threaded end portion configured to threadably mate with the threaded portion of the first component top, and a first component connector member located on a bottom portion of the first component container opposite the threaded end portion of the first component container, wherein the first component connector member has an unthreaded outer surface, wherein the first component container is adapted to receive the applicator when mated to the first component top;

a second component comprising:

a second component container having an empty interior portion, a first second component connector member located on a first end of the second component container, the first second component connector member having an outer surface that is unthreaded, and a second second component connector member located on a second end of the second component container opposite the first end of the second component container, the second second component connector member having an outer surface that is unthreaded;

a third component comprising:

a third component top, an elongate cosmetic product, a third component container adapted to carry the elongate cosmetic product and be received by the third component top and secured with a friction fit, a twist mechanism located on an end of the third component container opposite the third component top, and adapted to move the elongate cosmetic product between a retracted position when the twist mechanism is rotated in a first direction and an extended position when the twist mechanism is rotated in a second direction, and a third component connector member located on the end of the third component container opposite the third component top, wherein the third component connector member is connected to the twist mechanism, and wherein the third component connector member is configured to rotate with rotation of the twist mechanism;

a first spacer positioned between the first component and the second component, the first spacer having interior portions that are unthreaded and having a first end and a second end, the first end of the first spacer being configured to matingly receive the first component connector member on the first component, and the second end of the first spacer being configured to matingly receive the first component connector member of the second component; and a second spacer positioned between the second component and the third component, the second spacer having interior portions that are unthreaded and having a first end and a second end, the first end of the second spacer be configured to matingly receive the second component connector member of the second component, and the second end of the second spacer being configured to matingly receive the third component connector member of the third component.

2. A device according to claim 1 wherein the first component connector member of the first component has a first diameter, and wherein the first spacer has an internal diameter that is larger than the diameter of the first component connector member on the second end of the first component.

3. A device according to claim 1 wherein the first second component connector member of the second component has a first diameter, and wherein the first spacer has an internal diameter that is larger than the diameter of the first second component connector member on the first end of the second component.

4. A device according to claim 1 wherein the second second component connector member of the second component has a first diameter, and wherein the second spacer has an internal diameter that is larger than the diameter of the second second component connector member on the second end of the second component.

5. A device according to claim 1 wherein the third component connector member of the third component has a first diameter, and wherein the second spacer has an internal diameter that is larger than the diameter of the third component connector member of the third component.

6. A device according to claim 1 wherein each of the first spacer and the second spacer has an external circumference that is equal to the external circumference of medial sections of the first component, the second component and the third component.

7. A device according to claim 1 wherein the first component, the first spacer, the second component, the second spacer, and the third component are separable to define a separated position and are connectable to define a connected position; and wherein when connected to one another, the first component, the first spacer, the first component top, the second component, the second spacer, the third component, and the third component top have a uniform outer circumference, with exception to the twist mechanism which has an outer circumference that is greater than the outer circumference of the first component, the first component top, the first spacer, the second component, the second spacer, the third component, and the third component top.

8. A device according to claim 1 wherein the applicator fixedly secured to the first component top is a mascara applicator, and wherein the interior portion of the first component is configured to contain mascara.

9. A device according to claim 1 wherein the third component is configured to contain lipstick; and wherein the twist mechanism is configured to extend the lipstick between an extended position and a retracted position.

10. A device according to claim 1 wherein the second component is configured to be an empty container that is suitable for carrying a standard hair pin.

* * * * *